US006363345B1

(12) United States Patent
Marash et al.

(10) Patent No.: US 6,363,345 B1
(45) Date of Patent: Mar. 26, 2002

(54) SYSTEM, METHOD AND APPARATUS FOR CANCELLING NOISE

(75) Inventors: Joseph Marash, Haifa; Baruch Berdugo, Kiriat-Ata, both of (IL)

(73) Assignee: Andrea Electronics Corporation, Melville, NY (US)

( * ) Notice: Subject to any disclaimer, the term of this patent is extended or adjusted under 35 U.S.C. 154(b) by 0 days.

(21) Appl. No.: 09/252,874

(22) Filed: Feb. 18, 1999

(51) Int. Cl.[7] ..... G10L 21/02

(52) U.S. Cl. ..... 704/226; 704/233; 704/205

(58) Field of Search ..... 704/270, 500, 704/233, 200, 201, 205, 226, 227, 228, 211, 216; 379/22.08, 392.01, 3, 406.01, 406.12, 406.13, 406.14, 406.05

(56) References Cited

U.S. PATENT DOCUMENTS

| | | | |
|---|---|---|---|
| 2,379,514 | A | 7/1945 | Fisher |
| 2,972,018 | A | 2/1961 | Hawley et al. |
| 3,098,121 | A | 7/1963 | Wadsworth |
| 3,101,744 | A | 8/1963 | Warnaka |

(List continued on next page.)

FOREIGN PATENT DOCUMENTS

| | | |
|---|---|---|
| DE | 2640324 | 3/1978 |
| DE | 3719963 | 3/1988 |
| DE | 4008595 | 9/1991 |
| EP | 0 059 745 B1 | 9/1982 |
| EP | 0 380 290 A2 | 8/1990 |
| EP | 0 390 386 | 10/1990 |
| EP | 0 411 360 B1 | 2/1991 |
| EP | 0 509 742 A2 | 10/1992 |
| EP | 0 483 845 | 1/1993 |

(List continued on next page.)

OTHER PUBLICATIONS

B.D. Van Veen and K.M. Buckley, "Beamforming: A Versatile Approach to Spatial Filtering," IEEE ASSN Magazine, vol. 5, No. 2, Apr. 1988, pp. 4–24.

Beranek, *Acoustics* (American Institute of Physics, 1986) pp. 116–135.

Boll, IEEE Trans. on Acous., vol. ASSP–27, No. 2, Apr. 1979, pp. 113–120.

Daniel Sweeney, "Sound Conditioning Through DSP", The Equipment Authority, 1994.

(List continued on next page.)

*Primary Examiner*—Richemond Dorvil

(74) *Attorney, Agent, or Firm*—Frommer Lawrence & Haug; Thomas J. Kowalski

(57) ABSTRACT

A threshold detector precisely detects the positions of the noise elements, even within continuous speech segments, by determining whether frequency spectrum elements, or bins, of the input signal are within a threshold set according to current and future minimum values of the frequency spectrum elements. In addition, the threshold is continuously set and initiated within a predetermined period of time. The estimate magnitude of the input audio signal is obtained using a multiplying combination of the real and imaginary part of the input in accordance with the higher and lower values between the real and imaginary part of the signal. In order to further reduce instability of the spectral estimation, a two-dimensional smoothing is applied to the signal estimate using neighboring frequency bins and an exponential average over time. A filter multiplication effects the subtraction thereby avoiding phase calculation difficulties and effecting full-wave rectification which further reduces artifacts. Since the noise elements are determined within continuous speech segments, the noise is canceled from the audio signal nearly continuously thereby providing excellent noise cancellation characteristics. Residual noise reduction reduces the residual noise remaining after noise cancellation. Implementation may be effected in various noise canceling schemes including adaptive beamforming and noise cancellation using computer program applications installed as software or hardware.

47 Claims, 10 Drawing Sheets

Noise Processing

U.S. PATENT DOCUMENTS

| | | | |
|---|---|---|---|
| 3,170,046 | A | 2/1965 | Leale |
| 3,247,925 | A | 4/1966 | Warnaka |
| 3,262,521 | A | 7/1966 | Warnaka |
| 3,298,457 | A | 1/1967 | Warnaka |
| 3,330,376 | A | 7/1967 | Warnaka |
| 3,394,226 | A | 7/1968 | Andrews, Jr. |
| 3,416,782 | A | 12/1968 | Warnaka |
| 3,422,921 | A | 1/1969 | Warnaka |
| 3,562,089 | A | 2/1971 | Warnaka et al. |
| 3,702,644 | A | 11/1972 | Fowler et al. |
| 3,830,988 | A | 8/1974 | Mol et al. |
| 3,889,059 | A | 6/1975 | Thompson et al. |
| 3,890,474 | A | 6/1975 | Glicksberg |
| 4,068,092 | A | 1/1978 | Ikoma et al. |
| 4,122,303 | A | 10/1978 | Chaplin et al. |
| 4,153,815 | A | 5/1979 | Chaplin et al. |
| 4,169,257 | A | 9/1979 | Smith |
| 4,239,936 | A | 12/1980 | Sakoe |
| 4,241,805 | A | 12/1980 | Chance, Jr. |
| 4,243,117 | A | 1/1981 | Warnaka |
| 4,261,708 | A | 4/1981 | Gallagher |
| 4,321,970 | A | 3/1982 | Thigpen |
| 4,334,740 | A | 6/1982 | Wray |
| 4,339,018 | A | 7/1982 | Warnaka |
| 4,363,007 | A | 12/1982 | Haramoto et al. |
| 4,409,435 | A | 10/1983 | Ono |
| 4,417,098 | A | 11/1983 | Chaplin et al. |
| 4,433,435 | A | 2/1984 | David |
| 4,442,546 | A | 4/1984 | Ishigaki |
| 4,453,600 | A | 6/1984 | Thigpen |
| 4,455,675 | A | 6/1984 | Bose et al. |
| 4,459,851 | A | 7/1984 | Crostack |
| 4,461,025 | A | 7/1984 | Franklin |
| 4,463,222 | A | 7/1984 | Poradowski |
| 4,473,906 | A | 9/1984 | Warnaka et al. |
| 4,477,505 | A | 10/1984 | Warnaka |
| 4,489,441 | A | 12/1984 | Chaplin et al. |
| 4,490,841 | A | 12/1984 | Chaplin et al. |
| 4,494,074 | A | 1/1985 | Bose |
| 4,495,643 | A | 1/1985 | Orban |
| 4,517,415 | A | 5/1985 | Laurence |
| 4,527,282 | A | 7/1985 | Chaplin et al. |
| 4,530,304 | A | 7/1985 | Gardos |
| 4,539,708 | A | 9/1985 | Norris |
| 4,559,642 | A | 12/1985 | Miyaji et al. |
| 4,562,589 | A | 12/1985 | Warnaka et al. |
| 4,566,118 | A | 1/1986 | Chaplin et al. |
| 4,570,155 | A | 2/1986 | Skarman et al. |
| 4,581,758 | A | 4/1986 | Coker et al. |
| 4,589,136 | A | 5/1986 | Poldy et al. |
| 4,589,137 | A | 5/1986 | Miller |
| 4,600,863 | A | 7/1986 | Chaplin et al. |
| 4,622,692 | A | 11/1986 | Cole |
| 4,628,529 | A | 12/1986 | Borth et al. |
| 4,630,302 | A | 12/1986 | Kryter |
| 4,630,304 | A | 12/1986 | Borth et al. |
| 4,636,586 | A | 1/1987 | Schiff |
| 4,649,505 | A | 3/1987 | Zinser, Jr. et al. |
| 4,653,102 | A | 3/1987 | Hansen |
| 4,653,606 | A | 3/1987 | Flanagan |
| 4,654,871 | A | 3/1987 | Chaplin et al. |
| 4,658,426 | A | 4/1987 | Chabries et al. |
| 4,672,674 | A | 6/1987 | Clough et al. |
| 4,683,010 | A | 7/1987 | Hartmann |
| 4,696,043 | A | 9/1987 | Iwahara et al. |
| 4,718,096 | A | 1/1988 | Meisel |
| 4,731,850 | A | 3/1988 | Levitt et al. |
| 4,736,432 | A | 4/1988 | Cantrell |
| 4,741,038 | A | 4/1988 | Elko et al. |
| 4,750,207 | A | 6/1988 | Gebert et al. |
| 4,752,961 | A | 6/1988 | Kahn |
| 4,769,847 | A | 9/1988 | Taguchi |
| 4,771,472 | A | 9/1988 | Williams, III et al. |
| 4,783,798 | A | 11/1988 | Leibholz et al. |
| 4,783,817 | A | 11/1988 | Hamada et al. |
| 4,783,818 | A | 11/1988 | Graupe et al. |
| 4,791,672 | A | 12/1988 | Nunley et al. |
| 4,802,227 | A | 1/1989 | Elko et al. |
| 4,811,404 | A | 3/1989 | Vilmur et al. |
| 4,833,719 | A | 5/1989 | Carme et al. |
| 4,837,832 | A | 6/1989 | Fanshel |
| 4,847,897 | A | 7/1989 | Means |
| 4,862,506 | A | 8/1989 | Landgarten et al. |
| 4,878,188 | A | 10/1989 | Ziegler et al. |
| 4,908,855 | A | 3/1990 | Ohga et al. |
| 4,910,718 | A | 3/1990 | Horn |
| 4,910,719 | A | 3/1990 | Thubert |
| 4,928,307 | A | 5/1990 | Lynn |
| 4,930,156 | A | 5/1990 | Norris |
| 4,932,063 | A | 6/1990 | Nakamura |
| 4,937,871 | A | 6/1990 | Hattori |
| 4,947,356 | A | 8/1990 | Elliott et al. |
| 4,951,954 | A | 8/1990 | MacNeill |
| 4,955,055 | A | 9/1990 | Fujisaki et al. |
| 4,956,867 | A | 9/1990 | Zarek et al. |
| 4,959,865 | A | 9/1990 | Stettiner et al. |
| 4,963,071 | A | 10/1990 | Larwin et al. |
| 4,965,834 | A | 10/1990 | Miller |
| 4,977,600 | A | 12/1990 | Ziegler |
| 4,985,925 | A | 1/1991 | Langberg et al. |
| 4,991,433 | A | 2/1991 | Warnaka et al. |
| 5,001,763 | A | 3/1991 | Moseley |
| 5,010,576 | A | 4/1991 | Hill |
| 5,018,202 | A | 5/1991 | Takahashi et al. |
| 5,023,002 | A | 6/1991 | Schweizer et al. |
| 5,029,218 | A | 7/1991 | Nagayasu |
| 5,046,103 | A | 9/1991 | Warnaka et al. |
| 5,052,510 | A | 10/1991 | Gossman |
| 5,070,527 | A | 12/1991 | Lynn |
| 5,075,694 | A | 12/1991 | Donnangelo et al. |
| 5,086,385 | A | 2/1992 | Launey et al. |
| 5,086,415 | A | 2/1992 | Takahashi et al. |
| 5,091,954 | A | 2/1992 | Sasaki et al. |
| 5,097,923 | A | 3/1992 | Ziegler et al. |
| 5,105,377 | A | 4/1992 | Ziegler, Jr. |
| 5,117,461 | A | 5/1992 | Moseley |
| 5,121,426 | A | 6/1992 | Bavmhauer |
| 5,125,032 | A | 6/1992 | Meister et al. |
| 5,126,681 | A | 6/1992 | Ziegler, Jr. et al. |
| 5,133,017 | A | 7/1992 | Cain et al. |
| 5,134,659 | A | 7/1992 | Moseley |
| 5,138,663 | A | 8/1992 | Moseley |
| 5,138,664 | A | 8/1992 | Kimura et al. |
| 5,142,585 | A | 8/1992 | Taylor |
| 5,192,918 | A | 3/1993 | Sugiyama |
| 5,208,864 | A | 5/1993 | Kaneda |
| 5,209,326 | A | 5/1993 | Harper |
| 5,212,764 | A | 5/1993 | Ariyoshi |
| 5,219,037 | A | 6/1993 | Smith et al. |
| 5,226,077 | A | 7/1993 | Lynn et al. |
| 5,226,087 | A | 7/1993 | Ono |
| 5,241,692 | A | 8/1993 | Harrison et al. |
| 5,251,263 | A | 10/1993 | Andrea et al. |
| 5,251,863 | A | 10/1993 | Gossman et al. |
| 5,260,997 | A | 11/1993 | Gattey et al. |
| 5,272,286 | A | 12/1993 | Cain et al. |
| 5,276,740 | A | 1/1994 | Inanaga et al. |
| 5,311,446 | A | 5/1994 | Ross et al. |
| 5,311,453 | A | 5/1994 | Denenberg et al. |
| 5,313,555 | A | 5/1994 | Kamiya |
| 5,313,945 | A | 5/1994 | Friedlander |

5,315,661 A 5/1994 Gossman et al.
5,319,736 A 6/1994 Hunt
5,327,506 A 7/1994 Stites, III
5,332,203 A 7/1994 Gossman et al.
5,335,011 A 8/1994 Addeo et al.
5,348,124 A 9/1994 Harper
5,353,347 A 10/1994 Irissou et al.
5,353,376 A 10/1994 Oh et al.
5,361,303 A 11/1994 Eatwell
5,365,594 A 11/1994 Ross et al.
5,375,174 A 12/1994 Denenberg
5,381,473 A 1/1995 Andrea et al.
5,381,481 A 1/1995 Gammie et al.
5,384,843 A 1/1995 Masuda et al.
5,402,497 A 3/1995 Nishimoto et al.
5,412,735 A 5/1995 Engebretson et al.
5,414,769 A 5/1995 Gattey et al.
5,414,775 A 5/1995 Scribner et al.
5,416,845 A 5/1995 Shen
5,416,847 A 5/1995 Boze
5,416,887 A 5/1995 Shimada
5,418,857 A 5/1995 Eatwell
5,423,523 A 6/1995 Gossman et al.
5,431,008 A 7/1995 Ross et al.
5,432,859 A 7/1995 Yang et al.
5,434,925 A 7/1995 Nadim
5,440,642 A 8/1995 Denenberg et al.
5,448,637 A 9/1995 Yamaguchi et al.
5,452,361 A 9/1995 Jones
5,457,749 A 10/1995 Cain et al.
5,469,087 A 11/1995 Eatwell
5,471,106 A 11/1995 Curtis et al.
5,471,538 A 11/1995 Sasaki et al.
5,473,214 A 12/1995 Hildebrand
5,473,701 A 12/1995 Cezanee et al.
5,473,702 A 12/1995 Yoshida et al.
5,475,761 A 12/1995 Eatwell
5,479,562 A * 12/1995 Fielder et al. ..... 704/229
5,481,615 A 1/1996 Eatwell et al.
5,485,515 A 1/1996 Allen et al.
5,493,615 A 2/1996 Burke et al.
5,502,869 A 4/1996 Smith et al.
5,511,127 A 4/1996 Warnaka
5,511,128 A 4/1996 Lindeman
5,515,378 A 5/1996 Roy, III et al.
5,524,056 A 6/1996 Killion et al.
5,524,057 A 6/1996 Akiho et al.
5,526,432 A 6/1996 Denenberg
5,546,090 A 8/1996 Roy, III et al.
5,546,467 A 8/1996 Denenberg
5,550,334 A 8/1996 Langley
5,553,153 A 9/1996 Eatwell
5,563,817 A 10/1996 Ziegler et al.
5,568,557 A 10/1996 Ross et al.
5,581,620 A 12/1996 Brandstein et al.
5,592,181 A 1/1997 Cai et al.
5,592,490 A 1/1997 Barratt et al.
5,600,106 A 2/1997 Langley
5,604,813 A 2/1997 Evans et al.
5,615,175 A 3/1997 Cater et al.
5,617,479 A 4/1997 Hildebrand et al.
5,619,020 A 4/1997 Jones et al.
5,621,656 A 4/1997 Langley
5,625,697 A 4/1997 Bowen et al.
5,625,880 A 4/1997 Goldburg et al.
5,627,746 A 5/1997 Ziegler, Jr. et al.
5,627,799 A 5/1997 Hoshuyama
5,638,022 A 6/1997 Eatwell
5,638,454 A 6/1997 Jones et al.
5,638,456 A 6/1997 Conley et al.
5,642,353 A 6/1997 Roy, III et al.
5,644,641 A 7/1997 Ikeda
5,649,018 A 7/1997 Gifford et al.
5,652,770 A 7/1997 Eatwell
5,652,799 A 7/1997 Ross et al.
5,657,393 A 8/1997 Crow
5,664,021 A 9/1997 Chu et al.
5,668,747 A 9/1997 Obashi
5,668,927 A * 9/1997 Chan et al. ..... 704/240
5,673,325 A 9/1997 Andrea et al.
5,676,353 A 10/1997 Jones et al.
5,689,572 A 11/1997 Ohki et al.
5,692,053 A 11/1997 Fuller et al.
5,692,054 A 11/1997 Parrella et al.
5,699,436 A 12/1997 Claybaugh et al.
5,701,344 A 12/1997 Wakui
5,706,394 A * 1/1998 Wynn ..... 704/219
5,715,319 A 2/1998 Chu
5,715,321 A 2/1998 Andrea et al.
5,719,945 A 2/1998 Fuller et al.
5,724,270 A 3/1998 Posch
5,727,073 A 3/1998 Ikeda
5,732,143 A 3/1998 Andrea et al.
5,745,581 A 4/1998 Eatwell et al.
5,748,749 A 5/1998 Miller et al.
5,768,473 A 6/1998 Eatwell et al.
5,774,859 A 6/1998 Houser et al.
5,787,259 A * 7/1998 Haroun et al. ..... 709/253
5,798,983 A 8/1998 Kuhn et al.
5,812,682 A 9/1998 Ross et al.
5,815,582 A 9/1998 Claybaugh et al.
5,818,948 A * 10/1998 Gulick ..... 381/77
5,825,897 A 10/1998 Andrea et al.
5,825,898 A 10/1998 Marash
5,828,768 A 10/1998 Eatwell et al.
5,835,608 A 11/1998 Warnaka et al.
5,838,805 A 11/1998 Warnaka et al.
5,874,918 A 3/1999 Czarnecki et al.
5,909,495 A 6/1999 Andrea
5,914,877 A * 6/1999 Gulick ..... 364/400.01
5,914,912 A 6/1999 Yang
5,995,150 A * 11/1999 Hsieh et al. ..... 348/409

FOREIGN PATENT DOCUMENTS

EP 0 583 900 A1 2/1994
EP 0 595 457 A1 5/1994
EP 0 721 251 7/1996
EP 0 724 415 11/1996
FR 2305909 10/1976
GB 1 160 431 8/1969
GB 1 289 993 9/1972
GB 1 378 294 12/1974
GB 2 172 769 A 9/1986
GB 2 239 971 B 7/1991
GB 2 289 593 A 11/1995
JP 56-89194 7/1981
JP 59-64994 4/1984
JP 62-189898 8/1987
JP 1-149695 6/1989
JP 1-314098 12/1989
JP 2-070152 3/1990
JP 3-169199 7/1991
JP 3-231599 10/1991
JP 4-16900 1/1992
WO WO 88/09512 12/1988
WO WO 92/05538 4/1992
WO WO 92/17019 10/1992
WO WO 94/16517 7/1994
WO WO 95/08906 3/1995
WO WO 96/15541 5/1996
WO WO 97/23068 6/1997

OTHER PUBLICATIONS

Edward J. Foster, "Switched on Silence", Popular Science, 1994, p. 33.

Kuo, *Automatic Control of Systems*, pp. 504–585.

Luenberger, *Optimization by Vector Space Method*, pp. 134–138.

Ogata, *Modern Control Engineering*, pp. 474–508.

Oppenheim Schafer, *Digital Signal Processing* (Prentice Hall) pp. 542–545.

P.P. Vaidyanathan, "Multirate Digital Filters, Filter Banks, Polyphase Networks, and Applications; A Tutorial," IEEE Proc., vol. 78, No. 1, Jan. 1990.

P.P. Vaidyanathan, "Quadrature Mirror Filter Banks, M–band Extensions and Perfect–Reconstruction Techniques," IEEE ASSP Magazine, Jul. 1987, pp. 4–20.

Rabiner et al., IEEE Trans. on Acous., vol. ASSP–24, No. 5, Oct. 1976, pp. 399–418.

Rubiner et al., *Digital Processing of Speech Signals* (Prentice Hall, 1978) pp. 130–135.

Sapontis, *Probability, Lambda Variables and Structural Processes*, pp. 467–474.

Scott C. Douglas, "A Family of Normalized LMS Algorithms," IEEE Signal Proc. Letters, vol. 1, No. 3, Mar. 1994.

Sewald et al., "Application of . . . Beamforming to Reject Turbulence Noise in Airducts," IEEE ICASSP vol. 5, No. CONF–21, May 7, 1996, pp. 2734–2737.

White, *Moving–Coil Earphone Design*, 1963, pp. 188–194.

Widrow et al., "Adaptive Noise Canceling: Principles and Applications," Proc. IEEE, vol. 63, No. 12, Dec. 1975, pp. 1692–1716.

Youla et al., IEEE Trans. on Acous., vol. MI–1, No. 2, Oct. 1982, pp. 81–101.

* cited by examiner

Spectral Subtraction System

Noise Processing

Noise Estimation Process

Subtraction Process

Residual Noise Process

Residual Noise Process Alternative

SYSTEM, METHOD AND APPARATUS FOR CANCELLING NOISE

RELATED APPLICATIONS INCORPORATED BY REFERENCE

The following applications and patent(s) are cited and hereby herein incorporated by reference: U.S. patent Ser. No. 09/130,923 filed Aug. 6, 1998, U.S. patent Ser. No. 09/055,709 filed Apr. 7, 1998, U.S. patent Ser. No. 09/059,503 filed Apr. 13, 1998, U.S. patent Ser. No. 08/840,159 filed Apr. 14, 1997, U.S. patent Ser. No. 09/130,923 filed Aug. 6, 1998, U.S. patent Ser. No. 08/672,899 now issued U.S. Pat. No. 5,825,898 issued Oct. 20, 1998. And, all documents cited herein are incorporated herein by reference, as are documents cited or referenced in documents cited herein.

FIELD OF THE INVENTION

The present invention relates to noise cancellation and reduction and, more specifically, to noise cancellation and reduction using spectral subtraction.

BACKGROUND OF THE INVENTION

Ambient noise added to speech degrades the performance of speech processing algorithms. Such processing algorithms may include dictation, voice activation, voice compression and other systems. In such systems, it is desired to reduce the noise and improve the signal to noise ratio (S/N ratio) without effecting the speech and its characteristics.

Near field noise canceling microphones provide a satisfactory solution but require that the microphone in the proximity of the voice source (e.g., mouth). In many cases, this is achieved by mounting the microphone on a boom of a headset which situates the microphone at the end of a boom proximate the mouth of the wearer. However, the headset has proven to be either uncomfortable to wear or too restricting for operation in, for example, an automobile.

Microphone array technology in general, and adaptive beamforming arrays in particular, handle severe directional noises in the most efficient way. These systems map the noise field and create nulls towards the noise sources. The number of nulls is limited by the number of microphone elements and processing power. Such arrays have the benefit of hands-free operation without the necessity of a headset.

However, when the noise sources are diffused, the performance of the adaptive system will be reduced to the performance of a regular delay and sum microphone array, which is not always satisfactory. This is the case where the environment is quite reverberant, such as when the noises are strongly reflected from the walls of a room and reach the array from an infinite number of directions. Such is also the case in a car environment for some of the noises radiated from the car chassis.

OBJECTS AND SUMMARY OF THE INVENTION

The spectral subtraction technique provides a solution to further reduce the noise by estimating the noise magnitude spectrum of the polluted signal. The technique estimates the magnitude spectral level of the noise by measuring it during non-speech time intervals detected by a voice switch, and then subtracting the noise magnitude spectrum from the signal. This method, described in detail in Suppression of Acoustic Noise in Speech Using Spectral Subtraction, (Steven F Boll, IEEE ASSP-27 NO.2 April, 1979), achieves good results for stationary diffused noises that are not correlated with the speech signal. The spectral subtraction method, however, creates artifacts, sometimes described as musical noise, that may reduce the performance of the speech algorithm (such as vocoders or voice activation) if the spectral subtraction is uncontrolled. In addition, the spectral subtraction method assumes erroneously that the voice switch accurately detects the presence of speech and locates the non-speech time intervals. This assumption is reasonable for off-line systems but difficult to achieve or obtain in real time systems.

More particularly, the noise magnitude spectrum is estimated by performing an FFT of 256 points of the non-speech time intervals and computing the energy of each frequency bin. The FFT is performed after the time domain signal is multiplied by a shading window (Hanning or other) with an overlap of 50%. The energy of each frequency bin is averaged with neighboring FFT time frames. The number of frames is not determined but depends on the stability of the noise. For a stationary noise, it is preferred that many frames are averaged to obtain better noise estimation. For a non-stationary noise, a long averaging may be harmful. Problematically, there is no means to know a-priori whether the noise is stationary or non-stationary.

Assuming the noise magnitude spectrum estimation is calculated, the input signal is multiplied by a shading window (Hanning or other), an FFT is performed (256 points or other) with an overlap of 50% and the magnitude of each bin is averaged over 2–3 FFT frames. The noise magnitude spectrum is then subtracted from the signal magnitude. If the result is negative, the value is replaced by a zero (Half Wave Rectification). It is recommended, however, to further reduce the residual noise present during non-speech intervals by replacing low values with a minimum value (or zero) or by attenuating the residual noise by 30 dB. The resulting output is the noise free magnitude spectrum.

The spectral complex data is reconstructed by applying the phase information of the relevant bin of the signal's FFT with the noise free magnitude. An IFFT process is then performed on the complex data to obtain the noise free time domain data. The time domain results are overlapped and summed with the previous frame's results to compensate for the overlap process of the FFT.

There are several problems associated with the system described. First, the system assumes that there is a prior knowledge of the speech and non-speech time intervals. A voice switch is not practical to detect those periods. Theoretically, a voice switch detects the presence of the speech by measuring the energy level and comparing it to a threshold. If the threshold is too high, there is a risk that some voice time intervals might be regarded as a non-speech time interval and the system will regard voice information as noise. The result is voice distortion, especially in poor signal to noise ratio cases. If, on the other hand, the threshold is too low, there is a risk that the non-speech intervals will be too short especially in poor signal to noise ratio cases and in cases where the voice is continuous with little intermission.

Another problem is that the magnitude calculation of the FFT result is quite complex. This involves square and square root calculations which are very expensive in terms of computation load. Yet another problem is the association of the phase information to the noise free magnitude spectrum in order to obtain the information for the IFFT. This process requires the calculation of the phase, the storage of the information, and applying the information to the magnitude data—all are expensive in terms of computation and memory requirements. Another problem is the estimation of the noise spectral magnitude. The FFT process is a poor and unstable estimator of energy. The averaging-over-time of frames contributes insufficiently to the stability. Shortening the length of the FFT results in a wider bandwidth of each bin and better stability but reduces the performance of the system. Averaging-over-time, moreover, smears the data and, for this reason, cannot be extended to more than a few frames. This means that the noise estimation process proposed is not sufficiently stable.

It is therefore an object of this invention to provide a spectral subtraction system that has a simple, yet efficient mechanism, to estimate the noise magnitude spectrum even in poor signal-to-noise ratio situations and in continuous fast speech cases.

It is another object of this invention to provide an efficient mechanism that can perform the magnitude estimation with little cost, and will overcome the problem of phase association.

It is yet another object of this invention to provide a stable mechanism to estimate the noise spectral magnitude without the smearing of the data.

In accordance with the foregoing objectives, the present invention provides a system that correctly determines the non-speech segments of the audio signal thereby preventing erroneous processing of the noise canceling signal during the speech segments. In the preferred embodiment, the present invention obviates the need for a voice switch by precisely determining the non-speech segments using a separate threshold detector for each frequency bin. The threshold detector precisely detects the positions of the noise elements, even within continuous speech segments, by determining whether frequency spectrum elements, or bins, of the input signal are within a threshold set according to a minimum value of the frequency spectrum elements over a preset period of time. More precisely, current and future minimum values of the frequency spectrum elements. Thus, for each syllable, the energy of the noise elements is determined by a separate threshold determination without examination of the overall signal energy thereby providing good and stable estimation of the noise. In addition, the system preferably sets the threshold continuously and resets the threshold within a predetermined period of time of, for example, five seconds.

In order to reduce complex calculations, it is preferred in the present invention to obtain an estimate of the magnitude of the input audio signal using a multiplying combination of the real and imaginary parts of the input in accordance with, for example, the higher and the lower values of the real and imaginary parts of the signal. In order to further reduce instability of the spectral estimation, a two-dimensional (2D) smoothing process is applied to the signal estimation. A two-step smoothing function using first neighboring frequency bins in each time frame then applying an exponential time average effecting an average over time for each frequency bin produces excellent results.

In order to reduce the complexity of determining the phase of the frequency bins during subtraction to thereby align the phases of the subtracting elements, the present invention applies a filter multiplication to effect the subtraction. The filter function, a Weiner filter function for example, or an approximation of the Weiner filter is multiplied by the complex data of the frequency domain audio signal. The filter function may effect a full-wave rectification, or a half-wave rectification for otherwise negative results of the subtraction process or simple subtraction. It will be appreciated that, since the noise elements are determined within continuous speech segments, the noise estimation is accurate and it may be canceled from the audio signal continuously providing excellent noise cancellation characteristics.

The present invention also provides a residual noise reduction process for reducing the residual noise remaining after noise cancellation. The residual noise is reduced by zeroing the non-speech segments, e.g., within the continuous speech, or decaying the non-speech segments. A voice switch may be used or another threshold detector which detects the non-speech segments in the time-domain.

The present invention is applicable with various noise canceling systems including, but not limited to, those systems described in the U.S. patent applications incorporated herein by reference. The present invention, for example, is applicable with the adaptive beamforming array. In addition, the present invention may be embodied as a computer program for driving a computer processor either installed as application software or as hardware.

BRIEF DESCRIPTION OF THE DRAWINGS

Other objects, features and advantages according to the present invention will become apparent from the following detailed description of the illustrated embodiments when read in conjunction with the accompanying drawings in which corresponding components are identified by the same reference numerals.

DETAILED DESCRIPTION OF THE PREFERRED EMBODIMENTS

Figure 1:
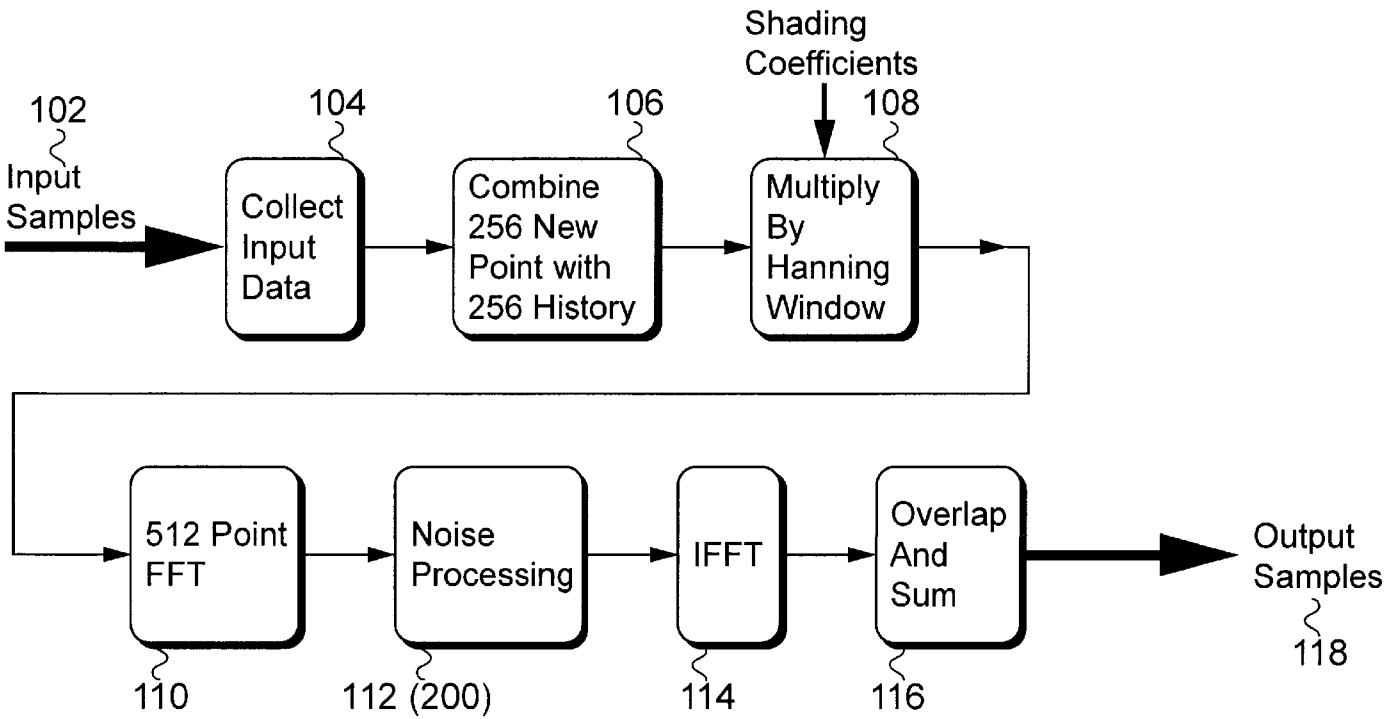
FIG. 1 illustrates the present invention.

FIG. 1 illustrates an embodiment of the present invention 100. The system receives a digital audio signal at input 102 sampled at a frequency which is at least twice the bandwidth of the audio signal. In one embodiment, the signal is derived from a microphone signal that has been processed through an analog front end, A/D converter and a decimation filter to obtain the required sampling frequency. In another embodiment, the input is taken from the output of a beamformer or even an adaptive beamformer. In that case the signal has been processed to eliminate noises arriving from directions other than the desired one leaving mainly noises originated from the same direction of the desired one. In yet another embodiment, the input signal can be obtained from a sound board when the processing is implemented on a PC processor or similar computer processor.

The input samples are stored in a temporary buffer 104 of 256 points. When the buffer is full, the new 256 points are combined in a combiner 106 with the previous 256 points to provide 512 input points. The 512 input points are multiplied by multiplier 108 with a shading window with the length of 512 points. The shading window contains coefficients that are multiplied with the input data accordingly. The shading window can be Hanning or other and it serves two goals: the first is to smooth the transients between two processed blocks (together with the overlap process); the second is to reduce the side lobes in the frequency domain and hence prevent the masking of low energy tonals by high energy side lobes. The shaded results are converted to the frequency domain through an FFT (Fast Fourier Transform) processor 110. Other lengths of the FFT samples (and accordingly input buffers) are possible including 256 points or 1024 points.

The FFT output is a complex vector of 256 significant points (the other 256 points are an anti-symmetric replica of the first 256 points). The points are processed in the noise processing block 112(200) which includes the noise magnitude estimation for each frequency bin—the subtraction process that estimates the noise-free complex value for each frequency bin and the residual noise reduction process. An IFFT (Inverse Fast Fourier Transform) processor 114 performs the Inverse Fourier Transform on the complex noise free data to provide 512 time domain points. The first 256 time domain points are summed by the summer 116 with the previous last 256 data points to compensate for the input overlap and shading process and output at output terminal 118. The remaining 256 points are saved for the next iteration.

It will be appreciated that, while specific transforms are utilized in the preferred embodiments, it is of course understood that other transforms may be applied to the present invention to obtain the spectral noise signal.

Figure 2:
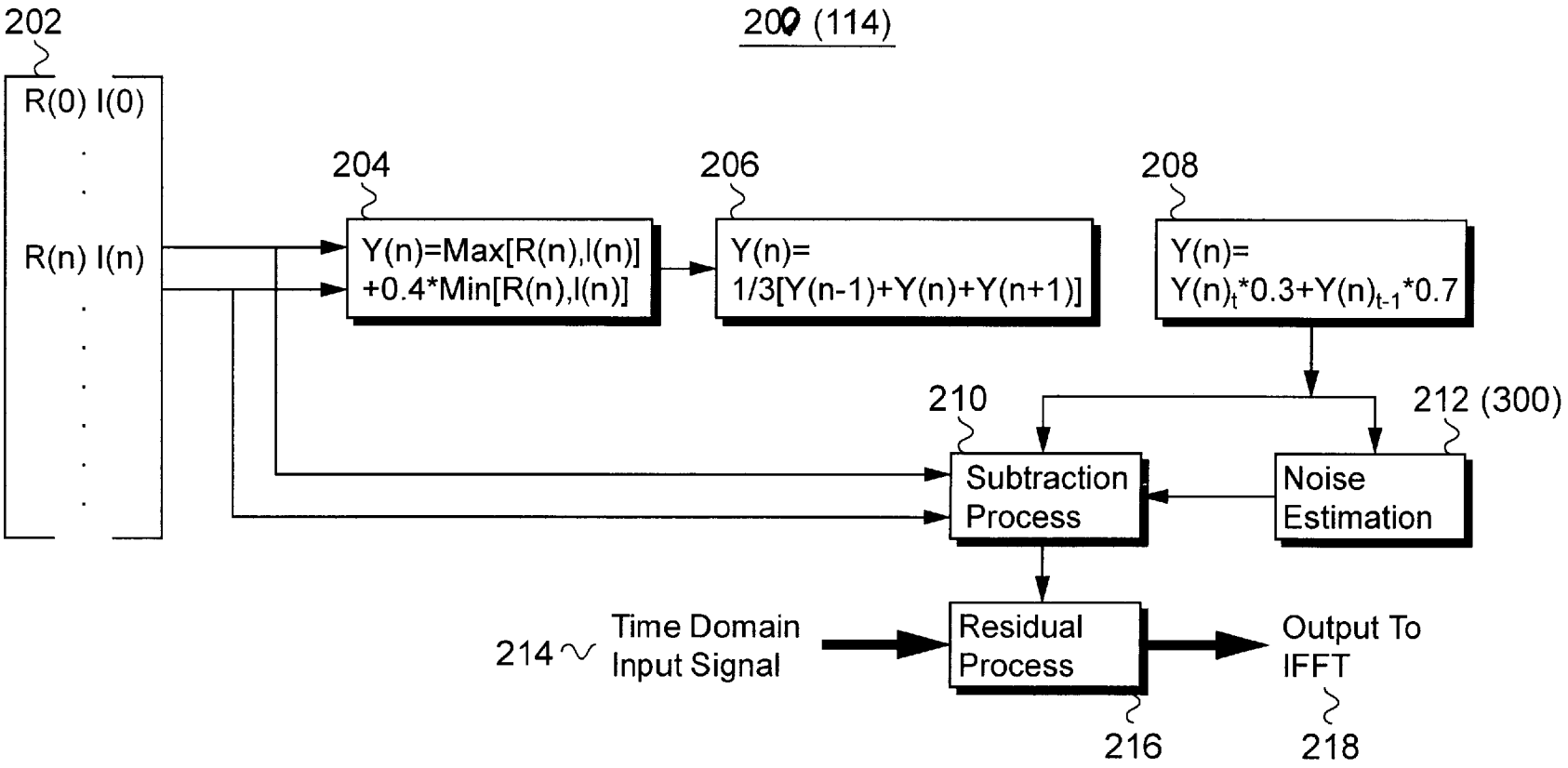
FIG. 2 illustrates the noise processing of the present invention.

FIG. 2 is a detailed description of the noise processing block 200(112). First, each frequency bin (n) 202 magnitude is estimated. The straight forward approach is to estimate the magnitude by calculating:

$$Y(n)=((\mathrm{Real}(n))^2+(\mathrm{Imag}(n))^2)^{-2}$$

In order to save processing time and complexity the signal magnitude (Y) is estimated by an estimator 204 using an approximation formula instead:

$$Y(n)=\mathrm{Max}[|\mathrm{Real}(n),\mathrm{Imag}(n)|]+0.4*\mathrm{Min}[|\mathrm{Real}(n),\mathrm{Imag}(n)|]$$

In order to reduce the instability of the spectral estimation, which typically plagues the FFT Process (ref[2] Digital Signal Processing, Oppenheim Schafer, Prentice Hall P. 542545), the present invention implements a 2D smoothing process. Each bin is replaced with the average of its value and the two neighboring bins' value (of the same time frame) by a first averager 206. In addition, the smoothed value of each smoothed bin is further smoothed by a second averager 208 using a time exponential average with a time constant of 0.7 (which is the equivalent of averaging over 3 time frames). The 2D-smoothed value is then used by two processes—the noise estimation process by noise estimation processor 212(300) and the subtraction process by subtractor 210. The noise estimation process estimates the noise at each frequency bin and the result is used by the noise subtraction process. The output of the noise subtraction is fed into a residual noise reduction processor 216 to further reduce the noise. In one embodiment, the time domain signal is also used by the residual noise process 216 to determine the speech free segments. The noise free signal is moved to the IFFT process to obtain the time domain output 218.

Figure 3:
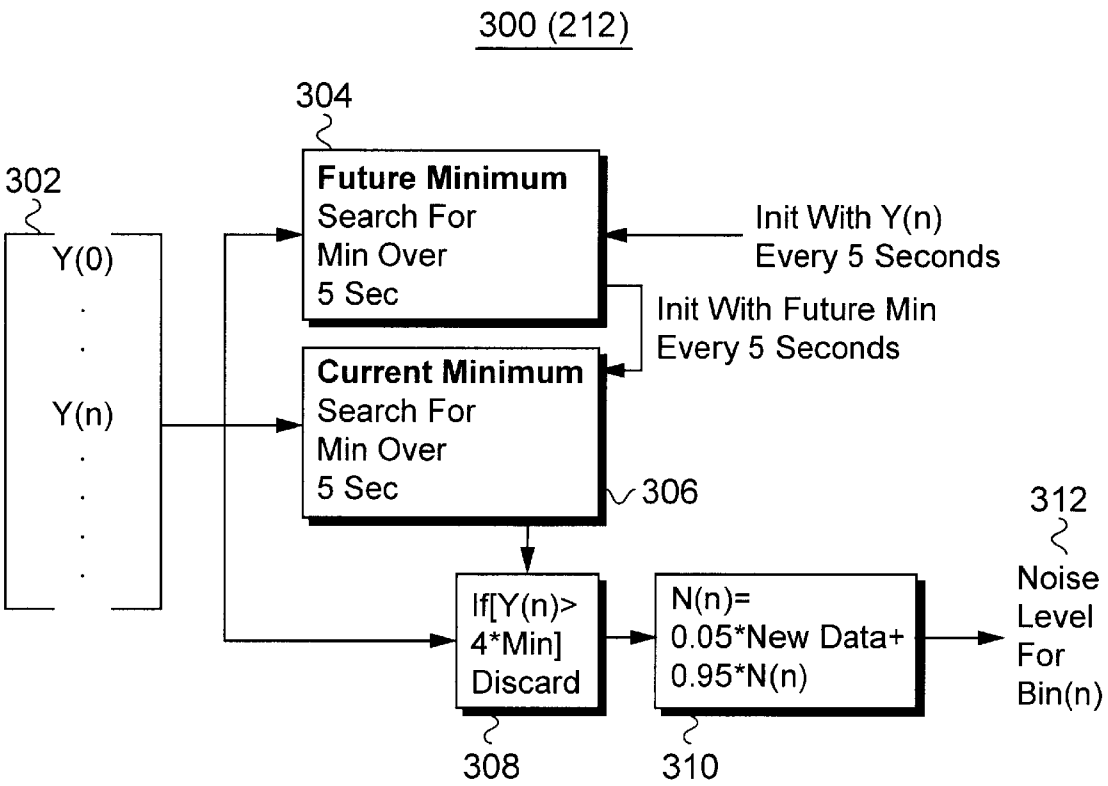
FIG. 3 illustrates the noise estimation processing of the present invention.

FIG. 3 is a detailed description of the noise estimation processor 300(212). Theoretically, the noise should be estimated by taking a long time average of the signal magnitude (Y) of non-speech time intervals. This requires that a voice switch be used to detect the speech/non-speech intervals. However, a too-sensitive a switch may result in the use of a speech signal for the noise estimation which will defect the voice signal. A less sensitive switch, on the other hand, may dramatically reduce the length of the noise time intervals (especially in continuous speech cases) and defect the validity of the noise estimation.

In the present invention, a separate adaptive threshold is implemented for each frequency bin 302. This allows the location of noise elements for each bin separately without the examination of the overall signal energy. The logic behind this method is that, for each syllable, the energy may appear at different frequency bands. At the same time, other frequency bands may contain noise elements. It is therefore possible to apply a non-sensitive threshold for the noise and yet locate many non-speech data points for each bin, even within a continuous speech case. The advantage of this method is that it allows the collection of many noise segments for a good and stable estimation of the noise, even within continuous speech segments.

In the threshold determination process, for each frequency bin, two minimum values are calculated. A future minimum value is initiated every 5 seconds at 304 with the value of the current magnitude (Y(n)) and replaced with a smaller minimal value over the next 5 seconds through the following process. The future minimum value of each bin is compared with the current magnitude value of the signal. If the current magnitude is smaller than the future minimum, the future minimum is replaced with the magnitude which becomes the new future minimum.

At the same time, a current minimum value is calculated at 306. The current minimum is initiated every 5 seconds with the value of the future minimum that was determined over the previous 5 seconds and follows the minimum value of the signal for the next 5 seconds by comparing its value with the current magnitude value. The current minimum value is used by the subtraction process, while the future minimum is used for the initiation and refreshing of the current minimum.

The noise estimation mechanism of the present invention ensures a tight and quick estimation of the noise value, with limited memory of the process (5 seconds), while preventing a too high an estimation of the noise.

Each bin's magnitude (Y(n)) is compared with four times the current minimum value of that bin by comparator 308—which serves as the adaptive threshold for that bin. If the magnitude is within the range (hence below the threshold), it is allowed as noise and used by an exponential averaging unit 310 that determines the level of the noise 312 of that frequency. If the magnitude is above the threshold it is rejected for the noise estimation. The time constant for the exponential averaging is typically 0.95 which may be interpreted as taking the average of the last 20 frames. The threshold of 4*minimum value may be changed for some applications.

Figure 4:
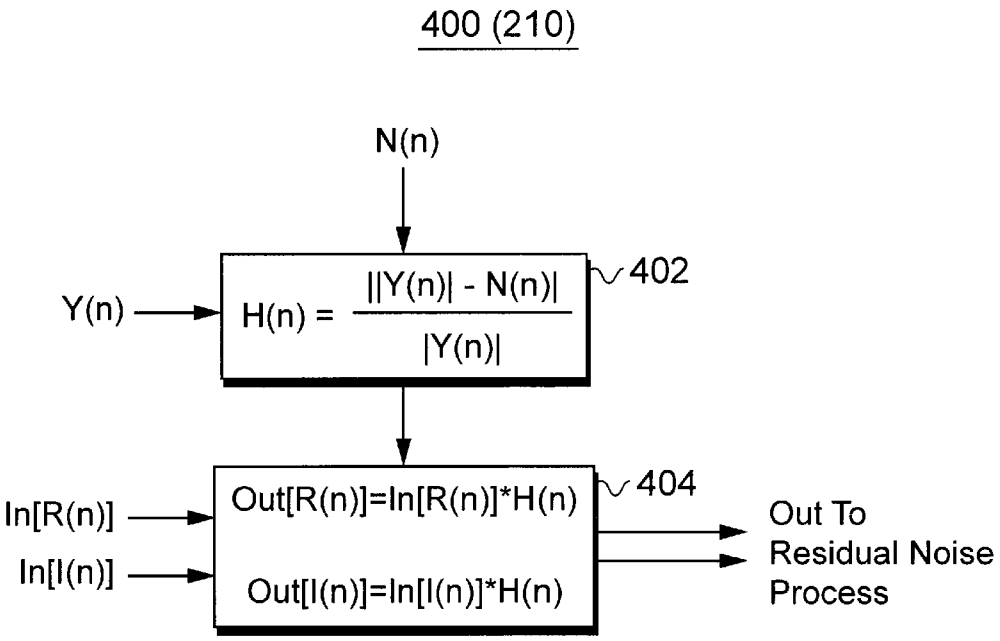
FIG. 4 illustrates the subtraction processing of the present invention.

FIG. 4 is a detailed description of the subtraction processor 400(210). In a straight forward approach, the value of the estimated bin noise magnitude is subtracted from the current bin magnitude. The phase of the current bin is calculated and used in conjunction with the result of the subtraction to obtain the Real and Imaginary parts of the result. This approach is very expensive in terms of processing and memory because it requires the calculation of the Sine and Cosine arguments of the complex vector with consideration of the 4 quarters where the complex vector may be positioned. An alternative approach used in this present invention is to use a Filter approach. The subtraction is interpreted as a filter multiplication performed by filter 402 where H (the filter coefficient) is:

$$H(n) = \frac{||Y(n)| - |N(n)||}{|Y(n)|}$$

Where Y(n) is the magnitude of the current bin and N(n) is the noise estimation of that bin. The value H of the filter coefficient (of each bin separately) is multiplied by the Real and Imaginary parts of the current bin at 404:

$$E(\text{Real})=Y(\text{Real})*H;E(\text{Imag})=Y(\text{Imag})*H$$

Where E is the noise free complex value. In the straight forward approach the subtraction may result in a negative value of magnitude. This value can be either replaced with zero (half-wave rectification) or replaced with a positive value equal to the negative one (full-wave rectification). The filter approach, as expressed here, results in the full-wave rectification directly. The full wave rectification provides a little less noise reduction but introduces much less artifacts to the signal. It will be appreciated that this filter can be modified to effect a half-wave rectification by taking the non-absolute value of the numerator and replacing negative values with zeros.

Note also that the values of Y in the figures are the smoothed values of Y after averaging over neighboring spectral bins and over time frames (2D smoothing). Another approach is to use the smoothed Y only for the noise estimation (N), and to use the unsmoothed Y for the calculation of H.

Figure 5:
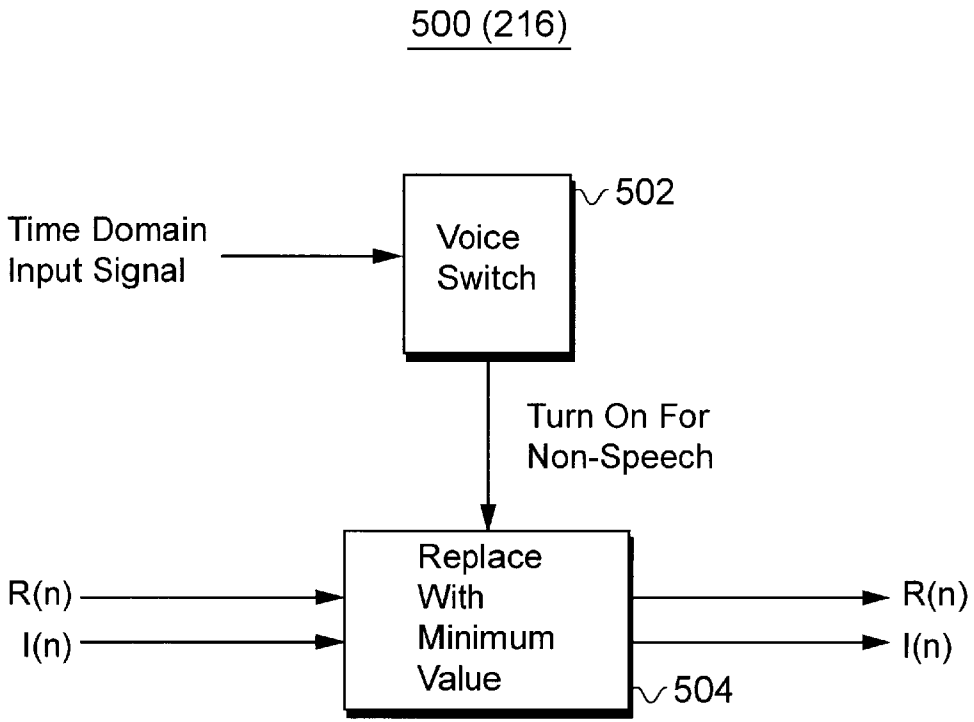
FIG. 5 illustrates the residual noise processing of the present invention.

FIG. 5 illustrates the residual noise reduction processor 500(216). The residual noise is defined as the remaining noise during non-speech intervals. The noise in these intervals is first reduced by the subtraction process which does not differentiate between speech and non-speech time intervals. The remaining residual noise can be reduced further by using a voice switch 502 and either multiplying the residual noise by a decaying factor or replacing it with zeros. Another alternative to the zeroing is replacing the residual noise with a minimum value of noise at 504.

Figure 5A:
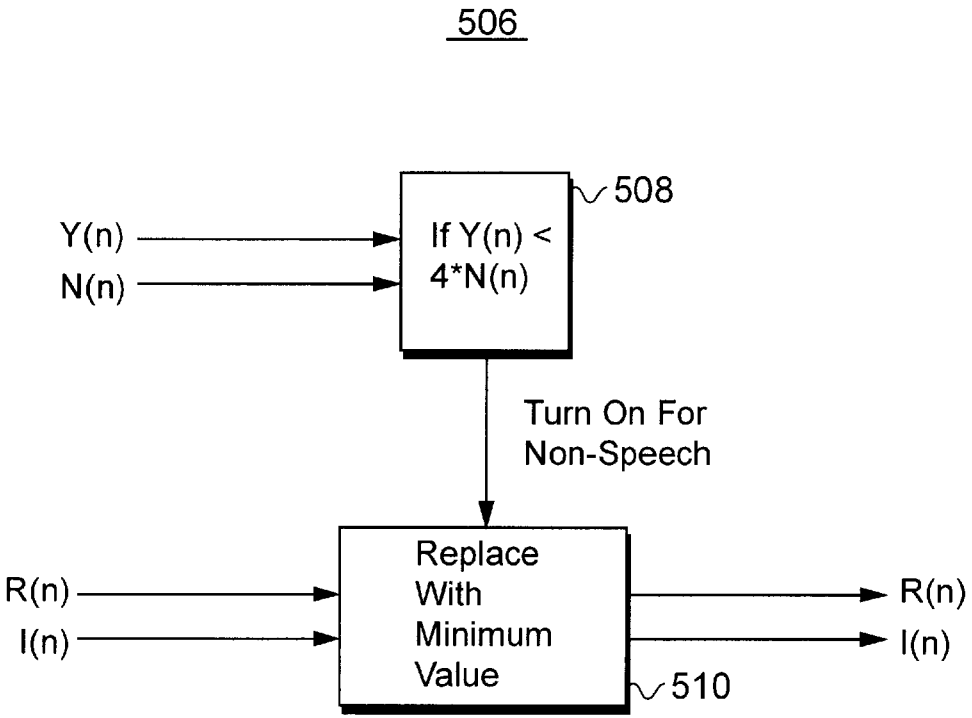
FIG. 5A illustrates a variant of the residual noise processing of the present invention.
Figure 6:
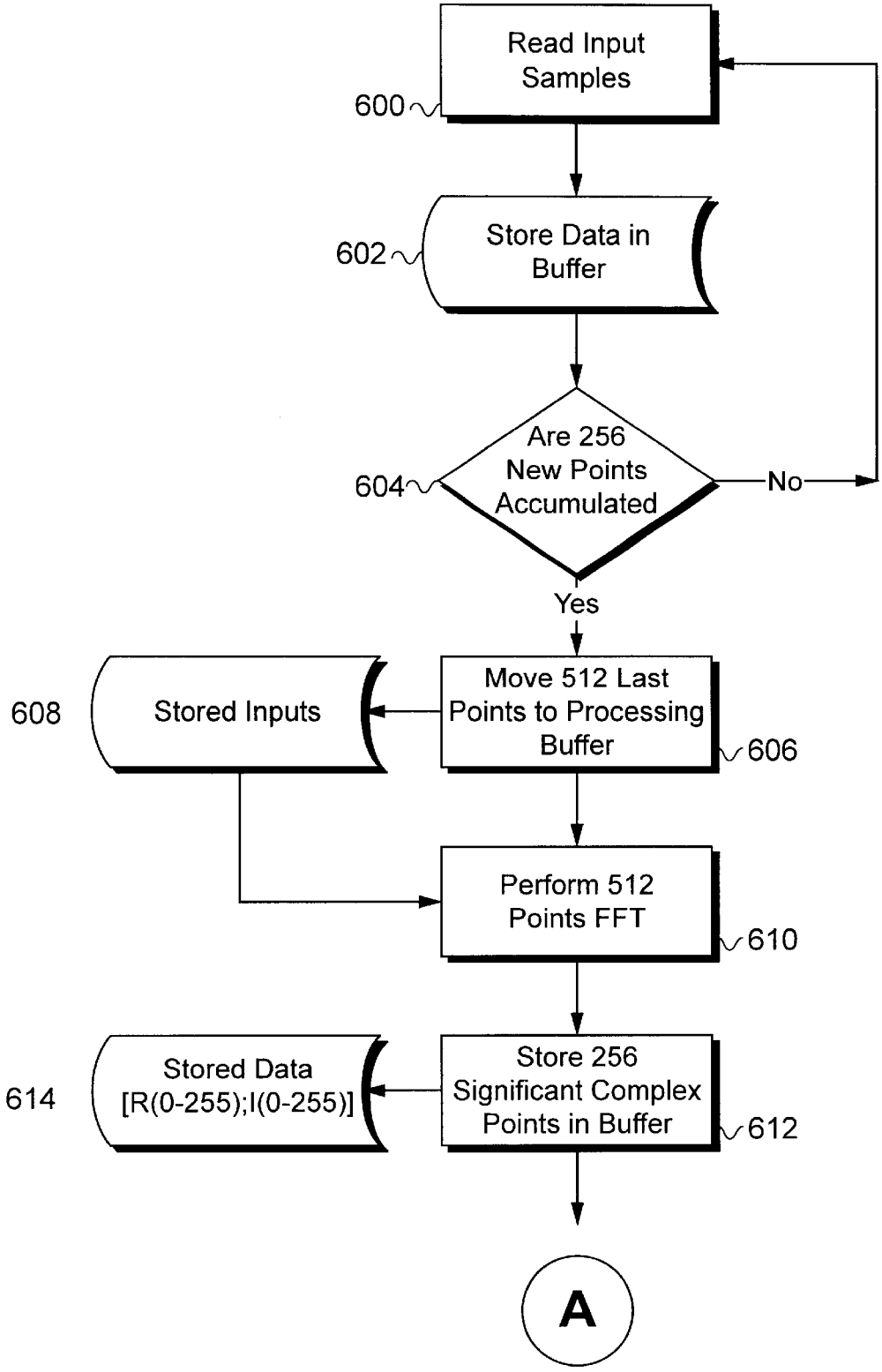
FIG. 6 illustrates a flow diagram of the present invention.

Yet another approach, which avoids the voice switch, is illustrated in FIG. 5A. The residual noise reduction processor 506 applies a similar threshold used by the noise estimator at 508 on the noise free output bin and replaces or decays the result when it is lower than the threshold at 510.

The result of the residual noise processing of the present invention is a quieter sound in the non-speech intervals. However, the appearance of artifacts such as a pumping noise when the noise level is switched between the speech interval and the non-speech interval may occur in some applications.

The spectral subtraction technique of the present invention can be utilized in conjunction with the array techniques, close talk microphone technique or as a stand alone system. The spectral subtraction of the present invention can be implemented on an embedded hardware (DSP) as a stand alone system, as part of other embedded algorithms such as adaptive beamforming, or as a software application running on a PC using data obtained from a sound port.

As illustrated in FIGS. 6–9, for example, the present invention may be implemented as a software application. In step 600, the input samples are read. At step 602, the read samples are stored in a buffer. If 256 new points are accumulated in step 604, program control advances to step 606—otherwise control returns to step 600 where additional samples are read. Once 256 new samples are read, the last 512 points are moved to the processing buffer in step 606. The 256 new samples stored are combined with the previous 256 points in step 608 to obtain the 512 points. In step 610, a Fourier Transform is performed on the 512 points. Of course, another transform may be employed to obtain the spectral noise signal. In step 612, the 256 significant complex points resulting from the transformation are stored in the buffer. The second 256 points are a conjugate replica of the first 256 points and are redundant for real inputs. The stored data in step 614 includes the 256 real points and the 256 imaginary points. Next, control advances to FIG. 7 as indicated by the circumscribed letter A.

Figure 7:
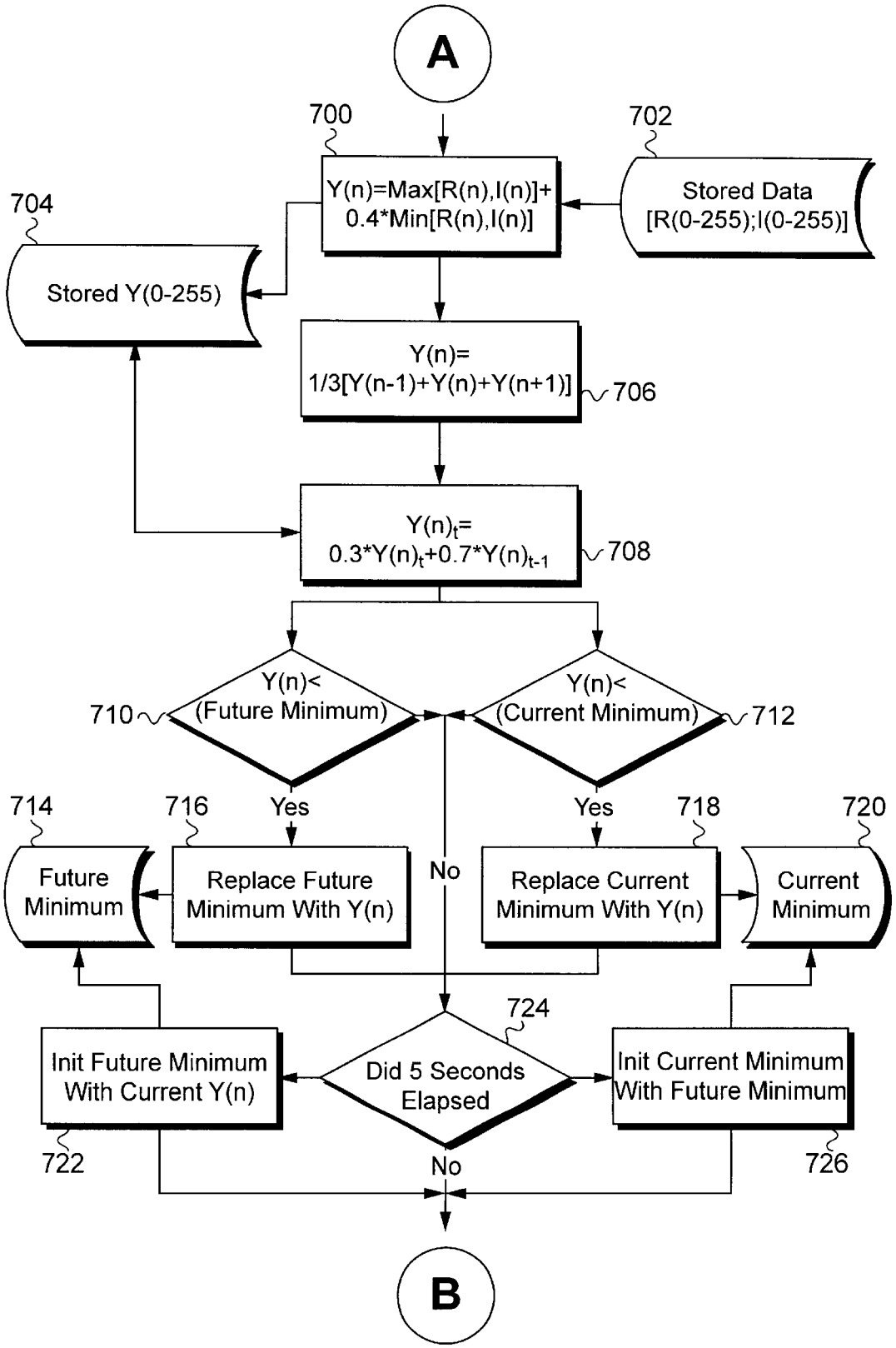
FIG. 7 illustrates a flow diagram of the present invention.

In FIG. 7, the noise processing is performed wherein the magnitude of the signal is estimated in step 700. Of course, the straight forward approach may be employed but, as discussed with reference to FIG. 2, the straight forward approach requires extraneous processing time and complexity. In step 702, the stored complex points are read from the buffer and calculated using the estimation equation shown in step 700. The result is stored in step 704. A 2-dimensional (2D) smoothing process is effected in steps 706 and 708 wherein, in step 706, the estimate at each point is averaged with the estimates of adjacent points and, in step 708, the estimate is averaged using an exponential average having the effect of averaging the estimate at each point over, for example, 3 time samples of each bin. In steps 710 and 712, the smoothed estimate is employed to determine the future minimum value and the current minimum value. If the smoothed estimate is less than the calculated future minimum value as determined in step 710, the future minimum value is replaced with the smoothed estimate and stored in step 714.

Meanwhile, if it is determined at step 712 that the smoothed estimate is less than the current minimum value, then the current minimum is replaced with the smoothed estimate value and stored in step 720. The future and current minimum values are calculated continuously and initiated periodically, for example, every 5 seconds as determined in step 724 and control is advanced to steps 722 and 726 wherein the new future and current minimum are calculated. Afterwards, control advances to FIG. 8 as indicated by the circumscribed letter B where the subtraction and residual noise reduction are effected.

Figure 8:
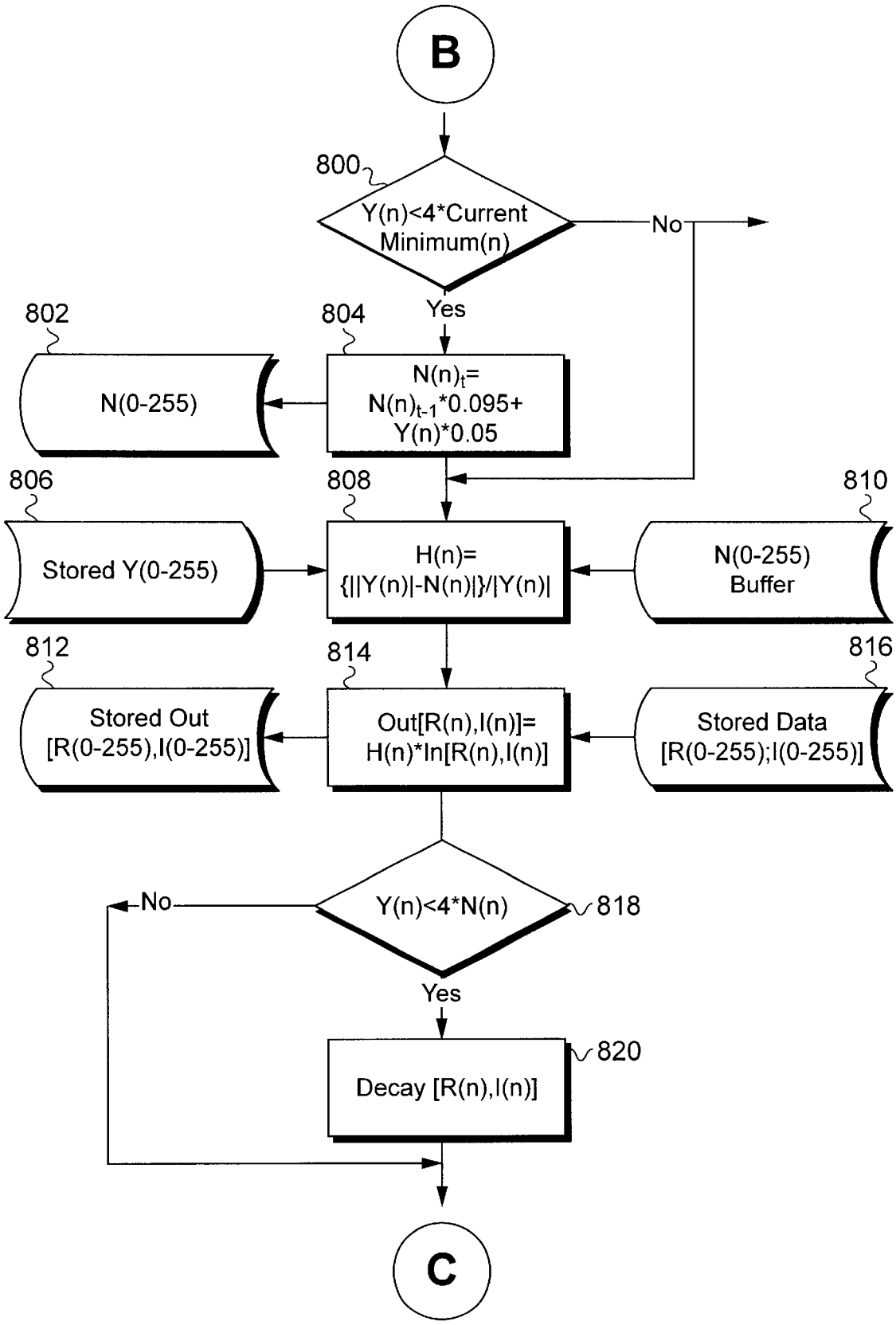
FIG. 8 illustrates a flow diagram of the present invention.

In FIG. 8, it is determined whether the samples are less than a threshold amount in step 800. In step 804, where the samples are within the threshold, the samples undergo an exponential averaging and stored in the buffer at step 802. Otherwise, control advances directly to step 808. At step 808, the filter coefficients are determined from the signal samples retrieved in step 806 the samples retrieved from step 810 is determined from the signal samples retrieved in step 806 and the estimated samples retrieved from step 810. Although the straight forward approach may be used by which phase is estimated and applied, the alternative Weiner Filter is preferred since this saves processing time and complexity. In step 814, the filter transform is multiplied by the samples retrieved from steps 816 and stored in step 812.

In steps 818 and 820, the residual noise reduction process is performed wherein, in step 818, if the processed noise signal is within a threshold, control advances to step 820 wherein the processed noise is subjected to replacement, for example, a decay. However, the residual noise reduction process may not be suitable in some applications where the application is negatively effected.

It will be appreciated that, while specific values are used as in the several equations and calculations employed in the present invention, these values may be different than those shown.

Figure 9:
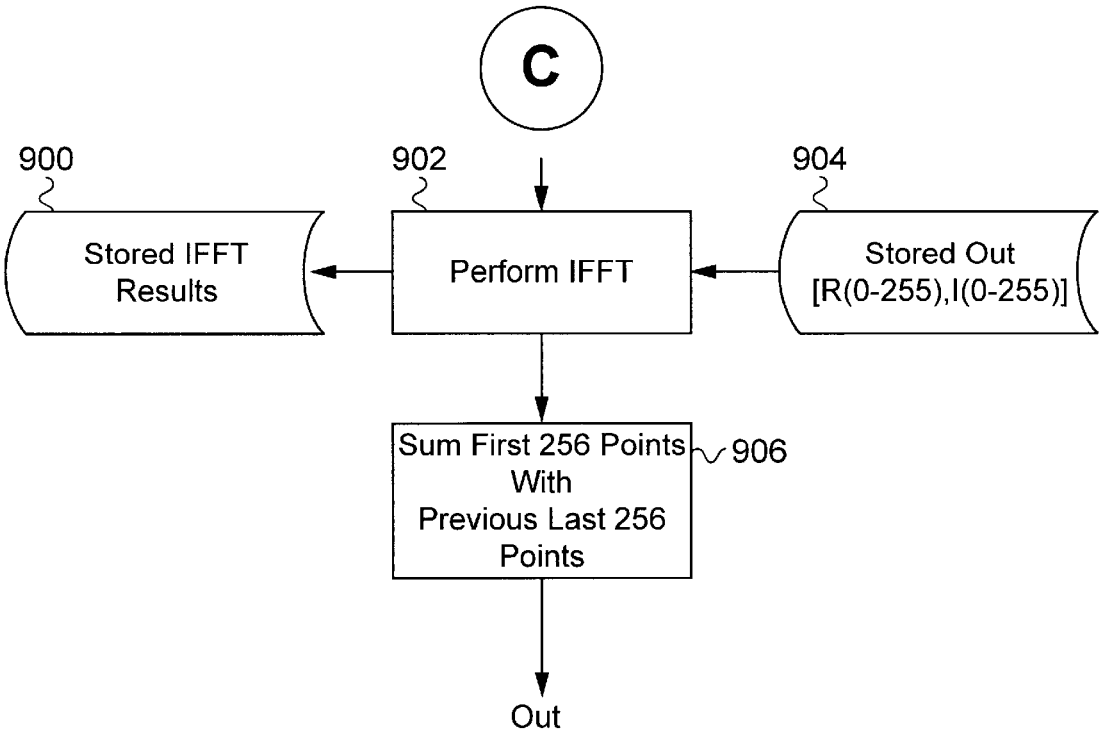
FIG. 9 illustrates a flow diagram of the present invention.

In FIG. 9, the Inverse Fourier Transform is generated in step 902 on the basis of the recovered noise processed audio signal recovered in step 904 and stored in step 900. In step 906, the time-domain signals are overlayed in order to regenerate the audio signal substantially without noise.

It will be appreciated that the present invention may be practiced as a software application, preferably written using C or any other programming language, which may be embedded on, for example, a programmable memory chip or stored on a computer-readable medium such as, for example, an optical disk, and retrieved therefrom to drive a computer processor. Sample code representative of the present invention is illustrated in Appendix A which, as will be appreciated by those skilled in the art, may be modified to accommodate various operating systems and compilers or to include various bells and whistles without departing from the spirit and scope of the present invention.

With the present invention, a spectral subtraction system is provided that has a simple, yet efficient mechanism, to estimate the noise magnitude spectrum even in poor signal to noise ratio situations and in continuous fast speech cases. An efficient mechanism is provided that can perform the magnitude estimation with little cost, and will overcome the problem of phase association. A stable mechanism is provided to estimate the noise spectral magnitude without the smearing of the data.

Although preferred embodiments of the present invention and modifications thereof have been described in detail herein, it is to be understood that this invention is not limited to those precise embodiments and modifications, and that other modifications and variations may be affected by one skilled in the art without departing from the spirit and scope of the invention as defined by the appended claims.

What is claimed is:

1. An apparatus for canceling noise, comprising:

an input for inputting an audio signal which includes a noise signal;

a frequency spectrum generator for generating the frequency spectrum of said audio signal thereby generating frequency bins of said audio signal; and a threshold detector for setting a threshold for each frequency bin using a noise estimation process and for detecting for each frequency bin whether the magnitude of the frequency bin is less than the corresponding threshold, thereby detecting the position of noise elements for each frequency bin.

2. The apparatus according to claim 1, wherein said threshold detector detects the position of a plurality of non-speech data points for said frequency bins.

3. The apparatus according to claim 2, wherein said threshold detector detects the position of said plurality of non-speech data points for said frequency bins within a continuous speech segment of said audio signal.

4. The apparatus according to claim 1, wherein said threshold detector sets the threshold for each frequency bin in accordance with a current minimum value of the magnitude of the corresponding frequency bin; said current minimum value being derived in accordance with a future minimum value of the magnitude of the corresponding frequency bin.

5. The apparatus according to claim 4, wherein said future minimum value is determined as the minimum value of the magnitude of the corresponding frequency bin within a predetermined period of time.

6. The apparatus according to claim 5, wherein said current minimum value is set to said future minimum value periodically.

7. The apparatus according to claim 6, wherein said future minimum value is replaced with the current magnitude value when said future minimum value is greater than said current magnitude value.

8. The apparatus according to claim 6, wherein said current minimum value is replaced with the current magnitude value when said current minimum value is greater than said current magnitude value.

9. The apparatus according to claim 5, wherein said future minimum value is set to a current magnitude value periodically; said current-magnitude value being the value of the magnitude of the corresponding frequency bin.

10. The apparatus according to claim 4, wherein said current minimum value is determined as the minimum value of the magnitude of the corresponding frequency bin within a predetermined period of time.

11. The apparatus according to claim 4, wherein said threshold is set by multiplying said current minimum value by a coefficient.

12. The apparatus according to claim 1, further comprising an averaging unit for determining a level of said noise within said respective frequency bin, wherein said threshold detector detects the position of said noise elements where said level of said noise determined by said averaging unit is less than the corresponding threshold.

13. The apparatus according to claim 1, further comprising a subtractor for subtracting said noise elements estimated at said positions determined by said threshold detector from said audio signal to derive said audio signal substantially without said noise.

14. The apparatus according to claim 13, wherein said subtractor performs subtraction using a filter multiplication which multiplies said audio signal by a filter function.

15. The apparatus according to claim 14, wherein said filter function is a Wiener filter function which is a function of said frequency bins of said noise elements and magnitude.

16. The apparatus according to claim 15, wherein said filter multiplication multiplies the complex elements of said frequency bins by said Weiner filter function.

17. The apparatus according to claim 13, further comprising a residual noise processor for reducing residual noise remaining after said subtractor subtracts said noise elements at said positions determined by said threshold detector from said audio signal.

18. The apparatus according to claim 17, wherein said residual noise processor replaces said frequency bins corresponding to non-speech segments of said audio signal with a minimum value.

19. The apparatus according to claim 18, wherein said residual noise processor includes a voice switch for detecting said non-speech segments.

20. The apparatus according to claim 18, wherein said residual noise processor includes another threshold detector for detecting said non-speech segments by detecting said audio signal is below a predetermined threshold.

21. The apparatus according to claim 1, further comprising an estimator for estimating a magnitude of each frequency bin.

22. The apparatus according to claim 21, wherein said estimator estimates said magnitude of each frequency bin as a function of the maximum and the minimum values of the complex element of said frequency bins for a number n of frequency bins.

23. The apparatus according to claim 21, further comprising a smoothing unit which smoothes the estimate of each frequency bin.

24. The apparatus according to claim 23, wherein said smoothing unit comprises a two-dimensional process which averages each frequency bin in accordance with neighboring frequency bins and averages each frequency bin using an exponential time average which effects an average over a plurality of frequency bins over time.

25. The apparatus according to claim 1, further comprising an adaptive array comprising a plurality of microphones for receiving said audio signal.

26. An apparatus for canceling noise, comprising:

input means for inputting an audio signal which includes a noise signal;

frequency spectrum generating means for generating the frequency spectrum of said audio signal thereby generating frequency bins of said audio signal; and threshold detecting means for setting a threshold for each frequency bin using a noise estimation process and for detecting for each frequency bin whether the magnitude of the frequency bin is less than the corresponding threshold, thereby detecting the position of noise elements for each frequency bin.

27. The apparatus according to claim 26, wherein said threshold detecting means sets the threshold for each frequency bin in accordance with a current minimum value of the magnitude of the corresponding frequency bin; said current minimum value being derived in accordance with a future minimum value of the magnitude of the corresponding frequency bin.

28. The apparatus according to claim 27, wherein said future minimum value is determined as the minimum value of the magnitude of the corresponding frequency bin within a predetermined period of time.

29. The apparatus according to claim 27, wherein said current minimum value is determined as the minimum value of the magnitude of the corresponding frequency bin within a predetermined period of time.

30. The apparatus according to claim 26, further comprising averaging means for determining a level of said noise within said respective frequency bin, wherein said threshold detecting means detects the position of said noise elements where said level of said noise determined by said averaging means is less than the corresponding threshold.

31. The apparatus according to claim 26, further comprising subtracting means for subtracting said noise elements at said positions determined by said threshold detecting means from said audio signal to derive said audio signal substantially without said noise.

32. The apparatus according to claim 31, wherein said subtracting performs subtraction using a filter multiplication which multiplies said audio signal by a filter function.

33. The apparatus according to claim 31, further comprising residual noise processing means for reducing residual noise remaining after said subtracting means subtracts said noise elements at said positions determined by said threshold detecting means from said audio signal.

34. The apparatus according to claim 26, further comprising estimating means for estimating a magnitude of each frequency bin.

35. The apparatus according to claim 34, wherein said estimating means estimates said magnitude of each frequency bin as a function of a maximum and a minimum of said frequency bins for a number n of frequency bins.

36. The apparatus according to claim 34, further comprising smoothing means for smoothing the estimate of each frequency bin.

37. The apparatus according to claim 26, further comprising adaptive array means comprising a plurality of microphones for receiving said audio signal.

38. A method for driving a computer processor for generating a noise canceling signal for canceling noise from an audio signal representing audible sound including a noise signal representing audible noise, said method comprising the steps of:

inputting said audio signal which includes said noise signal;

generating the frequency spectrum of said audio signal thereby generating frequency bins of said audio signal;

setting a threshold for each frequency bin using a noise estimation process;

detecting for each frequency bin whether the magnitude of the frequency bin is less than the corresponding threshold, thereby detecting the position of noise elements for each frequency bin; and subtracting said noise elements detected in said step of detecting from said audio signal to produce an audio signal representing said audible sound substantially without said audible noise.

39. The method according to claim 38, wherein said setting step sets the threshold for each frequency bin in accordance with a current minimum value of the magnitude of the corresponding frequency bin; said current minimum value being derived in accordance with a future minimum value of the magnitude of the corresponding frequency bin.

40. The method according to claim 39, wherein said setting step further comprises the step of determining said future minimum value as the minimum value of the magnitude of the corresponding frequency bin within a predetermined period of time.

41. The method according to claim 40, wherein said setting step further comprises the step of determining said future minimum value as the minimum value of the magnitude of the corresponding frequency bin within a predetermined period of time.

42. The method according to claim 40, further comprising the step of averaging a level of said noise of said respective frequency bin, wherein said step of detecting detects the position of said noise elements where said level of said noise determined by said step of averaging is less than the corresponding threshold.

43. The method according to claim 40, wherein said step of subtracting performs subtraction using a filter multiplication which multiplies said audio signal by a filter function.

44. The method according to claim 40, further comprising the step of estimating a magnitude of each frequency bin as a function of a maximum and a minimum of said frequency bins for a number n of frequency bins.

45. The method according to claim 44, further comprising the step of smoothing the estimate of each frequency bin.

46. The method according to claim 39, further comprising the step of receiving said audio signal from an adaptive array of a plurality of microphones.

47. The method according to claim 38, further comprising the step of reducing the residual noise remaining after said step of subtracting subtracts said noise elements at said positions determined by said step of detecting from said audio signal.

* * * * *